US005988153A

United States Patent [19]

Yoshimura

[11] Patent Number: 5,988,153

[45] Date of Patent: Nov. 23, 1999

[54] PAINT BALL GUN

[75] Inventor: Haruhiko Yoshimura, Kanagawaken, Japan

[73] Assignee: Galactic System, Inc., Cedar Rapids, Iowa

[21] Appl. No.: 08/951,376

[22] Filed: Oct. 16, 1997

[51] Int. Cl.[6] ..... F41B 11/00

[52] U.S. Cl. ..... 124/81; 124/83; 124/84

[58] Field of Search ..... 124/81, 83, 84, 124/85, 72, 73

[56] References Cited

U.S. PATENT DOCUMENTS

| | | | |
|---|---|---|---|
| 2,182,369 | 12/1939 | Barron | 124/81 |
| 5,265,583 | 11/1993 | Otto | 124/81 |
| 5,413,085 | 5/1995 | Kraeft | 124/81 |
| 5,634,456 | 6/1997 | Perrone | 124/76 |
| 5,640,945 | 6/1997 | Slonaker et al. | 124/56 |
| 5,655,510 | 8/1997 | Kunimoto | 124/81 |
| 5,735,256 | 4/1998 | Monk | 124/65 |

*Primary Examiner*—J. Woodrow Eldred

*Attorney, Agent, or Firm*—Schwegman, Lundberg, Woessner & Kluth PA

[57] ABSTRACT

The present invention includes a device for increasing distance traversed by a projectile. The device includes a main body comprising a tubular component wherein the tubular component defines an orifice. The main body also comprises a collar component positionable about the tubular component. The collar component enclosed a second orifice for receipt of a screw. A tab is positioned adjacent to the orifice which is defined by the tubular component. The tab includes an oblique section. A screw is positionable in the collar component and extends through the orifice defined by the tubular component. The screw is in moveable contact with the oblique segment of the tab.

8 Claims, 3 Drawing Sheets

PAINT BALL GUN

BACKGROUND OF INVENTION

The present invention relates to a device for extending distances of projectiles shot from a gun and to a method for increasing distance traversed by a projectile shot from a gun.

Guns are made in a variety of different sizes utilizing a variety of different propellants. Guns are comprised generally of a main body that includes a barrel closeable at one end by a sliding block, known as a breach block or a screw. The breach block defines a chamber for receipt of a propellant charge such as a bullet or a paint ball charge. Extending from the chamber is a tapered transition region to the barrel.

In one embodiment, the barrel, which includes an inner radial surface, is provided with spiral grooves on the inner radial surface. These spiral grooves are also known as "rifles." The rifles also called "rifling" impart a spinning motion to the projectile. Rifling is typically at a pitch which is expressed as a multiple of a bore diameter defined by the barrel. For instance, the pitch may be forty times the bore, which means that the projectile performs one revolution about its longitudinal axis over a distance equal to forty times the bore diameter of the barrel.

When the gun is loaded, a soft metal driving band at one end of the projectile is pressed into the rifling grooves, thereby centering the projectile in the barrel. When the gun is fired, a firing pin strikes a primer. This action ignites the charge which may be either enclosed in a cartridge, or entirely separate from the projectile. Explosive powder in the charge burns extremely rapidly and develops a very high gas pressure in the chamber, on the order of 45,000 psi. When the gas pressure exceeds the pressure with which the driving band is gripped in the rifling, the projectile is set in motion so that the space behind the projectile increases in volume as the gas expands. After an initial pressure builds up in the chamber, there is a drop in pressure as the projectile travels along the barrel. At the instant the projectile leaves the muzzle of the gun, the gas still has a high pressure which causes the report when the gas escapes into the atmosphere.

Gas pressure developed when the gun is fired produces high stresses, particularly in the interior of the barrel. Because of these high stresses, one piece barrels, called "mono-block" barrels, are used principally for guns of relatively small caliber. Medium and large caliber guns are barrels of a composite construction.

In a firing position, the breach block is locked against the force of any exploding charge. In addition to a mechanism for moving the block, the breach block also includes a firing pin and an extraction system for removing the spent cartridge case when the breach block is opened after the gun has been fired.

Typically in a gun, the expulsion of the projectile is accompanied by a recoil movement of the barrel. Hydraulic breaking cylinders may be used to arrest this movement. A piston rod attached to the barrel pulls the piston back when the barrel recoils so that hydraulic fluid behind the piston is forced through narrow passages into a space in front of the piston, thereby producing a breaking effect.

This general type of gun device has been used to project everything from bullets to paint balls. Several patents are directed specifically to paint ball guns. The Gardner patent, U.S. Pat. No. 5,228,427, describes an improved barrel for a paint ball gun. The barrel includes a number of radial holes drilled in a spiral pattern in order to cause the paint ball to spin around its longitudinal axis in flight. The Gardner patent describes the paint ball as stabilized in flight by imparting angular momentum to the ball about its longitudinal axis. No aerodynamic effect is described.

The Slonaker et al. patent, U.S. Pat. No. 5,640,945, issuing Jun. 24, 1997, describes a paint ball and gun that improve the range and accuracy of paint ball projections. The paint ball includes an external surface contoured to increase frictional interaction with air. The barrel and paint ball gun interact so that a significant back spin is imparted to the ball. The interaction includes a plurality of closed internal recesses and open internal recesses. The open internal recesses are vented to the atmosphere.

SUMMARY OF THE INVENTION

The present invention includes a device for increasing distance traversed by a projectile. The device includes a main body that comprises a tubular component wherein the tubular component defines an orifice. A collar component is positionable on the tubular component. The collar component encloses a second orifice for receipt of a screw. A tab is positioned adjacent to the orifice defined by the tubular component. The tab includes an oblique segment. A screw is positionable in the collar component. The screw extends through the orifice defined by the tubular component. The screw is in moveable contact with the oblique segment of the tab.

The present invention also includes a method for increasing distance traversed by a projectile. The method includes providing a main body with an annular section that encloses an orifice and a collar section positionable about the orifice. The collar section also includes an orifice for receipt of a screw. The main body further includes a tab having an oblique segment attached adjacent to the orifice defined by the tubular section. Next, the screw is turned until the oblique section of the tab that is contacted by the screw is moved downwardly by the screw. The main body is attached to a barrel of a gun. A projectile is added to the gun and the gun is activated so that the projectile contacts the tab which imparts a backspin to the projectile and increases the distance traversed by the projectile.

DETAILED DESCRIPTION OF PREFERRED EMBODIMENTS

Figure 1:
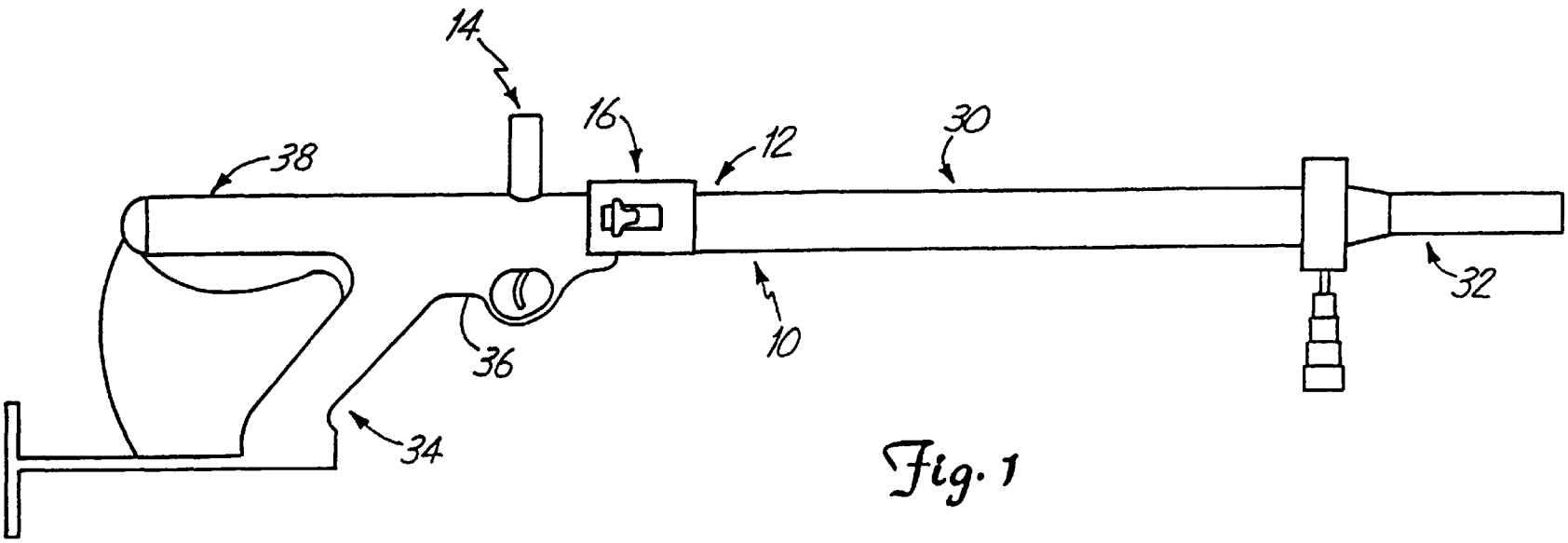
FIG. 1 is a perspective embodiment of the projectile distance enhancing device of the present invention when installed on a paint ball gun.
Figure 2A:
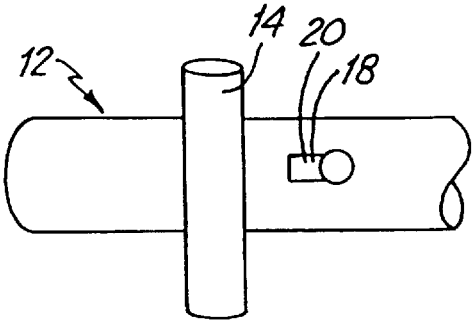
FIG. 2*a* is a top plan view of a first component of the projection enhancing device of the present invention.
Figure 2B:
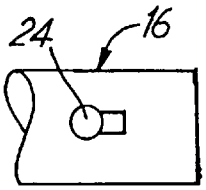
FIG. 2*b* is a top plan view of a second component of the projection enhancing device of the present invention.
Figure 3:
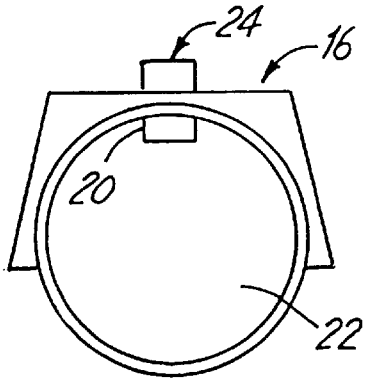
FIG. 3 is a cross-sectional view of the projection enhancing device of the present invention wherein the second component is installed on the first component.

The projection enhancing device of the present invention illustrated generally at 10 in FIGS. 2*a* and 2*b* includes an annular main body 12, a second annular portion 14 attached to the annular main body 12 so that the second annular portion 14, for receipt of a paint ball, is substantially perpendicular to the annular main body 12 and a collar component 16, illustrated in FIGS. 1 and 3, the collar component 16 slidably positionable over the main body 12, as illustrated in cross section in FIG. 3. The slidable collar component 16 is, in particular, positioned over an orifice 18 defined by the main body 12 in FIG. 2*a*. Fastened adjacent to the orifice 18 is a tab 20 that is attached to the main body 12 and that extends within the orifice 18 into a space or barrel 22 defined by the annular main body 12 and shown in FIG. 3 and FIG. 6*a*.

Figure 4:
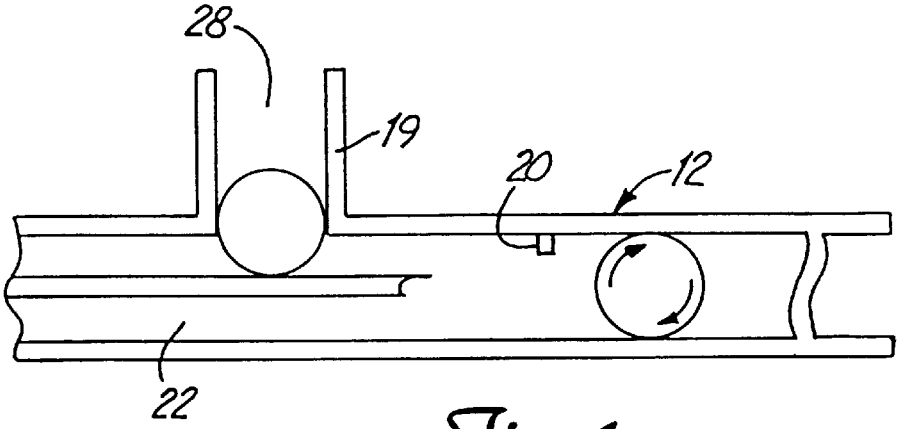
FIG. 4 is a side view of the projection enhancing device of the present invention.

The device 10 and in particular the tab 20, are sized, positioned and shaped in order to generate a back spin on projections such as paint balls 28, enabling the projections to travel longer distances than hereto expected once the device 10 is installed on a paint ball gun 30. As the paint ball 28 is propelled out of the barrel 22 of the main body 12 of the paint ball gun, the paint ball 28 contacts the tab 20, which is preferably made of a silicone rubber gum as is shown in FIG. 4.

Contact with the tab 20 imparts a resistance to one or more of the linear momentum or the angular momentum of the ball 28. In particular, the resistance imparts to the paint ball 28, a back spin which, it has been found, enables the ball to travel a longer distance as shown in FIG. 4.

Figure 5A:
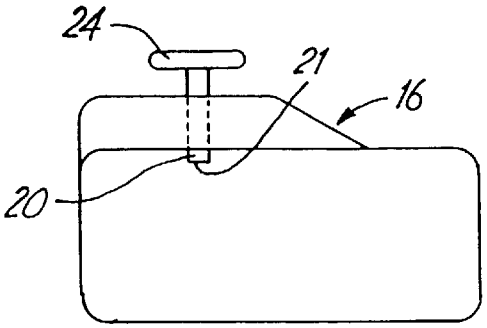
FIG. 5*a* is a side cutaway view of the projection enhancing device of the present invention with a tab component in the "lowest" position.
Figure 5B:
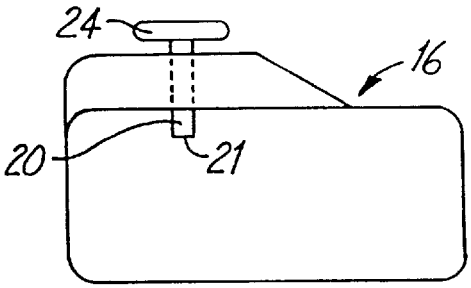
FIG. 5*b* is a side cutaway view of the projection enhancing device of the present invention with the tab component in an intermediate position.
Figure 5C:
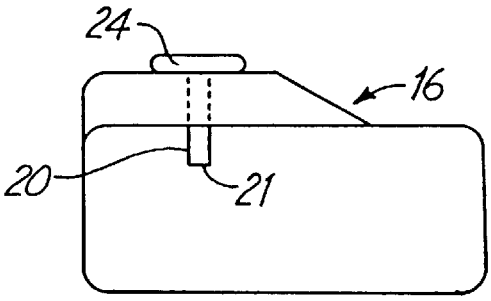
FIG. 5*c* is a side cutaway view of the projection device of the present invention with the tab component in the "highest" position.
Figure 6A:
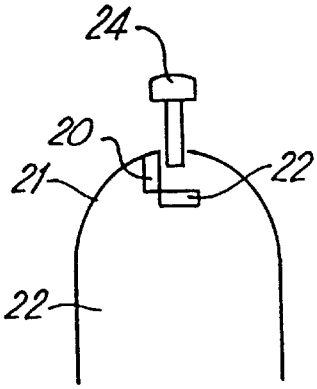
FIG. 6*a* is a side cutaway view of the tab of the present invention in a first position.
Figure 6B:
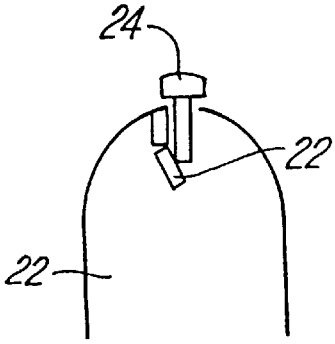
FIG. 6*b* is a side cutaway view of the tab of the present invention in a second position.

The device of the present invention 10 also includes a screw 24 positioned through the collar component 16 and over the tab 20 as shown in FIG. 6*a*. The tab 20 includes a vertical segment 21, attached to the main body 12 and an oblique segment 22 integral with the vertical segment 21. It is also contemplated that the tab include a single oblique portion. The screw 24 changes the position of the oblique segment 22 of the tab 20 with respect to the annular wall of the main body 12. In particular, the screw 24 is manually rotated until the screw 24 contacts the oblique segment 22 of the tab 20 as shown in FIG. 6*b*. Further movement of the screw 24 repositions the oblique segment 22 of the tab 20 into the barrel. The positions include a "low" position wherein the oblique segment 22 of tab 20 is only slightly offset from the inner annular wall of main body 12 as shown in FIG. 5*b*. The oblique segment 22 of tab 20 may also be positioned to a "high" position where the oblique segment 22 of tab 20 is further removed from the inner wall of the annular main body 12, as shown in FIG. 5*c*.

By turning the screw 24, counterclockwise, the tab 20 is adjusted to produce a projectile having a reduced or lesser back spin. Turning the screw 24 clockwise adjusts the tab 20 to produce a projectile that has an increased or greater back spin. When the oblique segment 22 of tab 20 is in the "high" position, the tab 20 imparts a greater resistance to the ball 28. This greater resistance creates a greater back spin and allows the ball to travel further. With minor trim or movement of the screw 24, the oblique segment 22 of the tab 20 is adjustable over a wide variety of resistance possibilities.

While a tab 20 with a vertical segment and an oblique segment are described, it is understood that the tab 20 may be a single unit having an oblique orientation with respect to the horizontal. With this embodiment, the screw 24 contacts the tab, thereby changing the tab's orientation within the barrel 32 of a gun.

The device of the present invention may be used in a paint ball gun of the invention, illustrated in FIG. 1, which includes an elongated barrel 32, a pistol grip 34, a trigger 36, a magazine for supply of paint balls 14, a compressed gas cartridge for supplying propellant gas and other conventional parts.

The type of gun illustrated in FIG. 1 is a type of "pump" gun. A user physically compresses propellant gas or stores energy in a spring. Conventional mechanical features of the gun are generally applicable to the gun of the present invention, together with such additional improvements as may be made in the future. The improvements made in the present invention relate to the barrel of the gun and to an interaction between the paint ball and the gun.

The device of the present invention may be utilized as an integral part of the paint gun 30 such as is shown in FIG. 1. In particular, the device 10 is an integral part of the barrel 32. The device 10 may also be threaded into a barrel of a conventional paint ball gun or may be attached by another conventional attachment mechanism.

Although the present invention has been described with reference to preferred embodiments, workers skilled in the art will recognize that changes may be made in form and detail without departing from the spirit and scope of the invention.

What is claimed is:

1. A device for increasing distance traversed by a paint ball, comprising:

a main body that includes a tubular component wherein the tubular component defines an orifice;

a collar component positionable on the tubular component, the collar component enclosing a second orifice for receipt of a screw;

a tab made of latex rubber positioned adjacent to the orifice defined by the tubular component, the tab including an oblique segment; and a single screw positionable in the collar component, extending through the orifice defined by the tubular component wherein the screw is in moveable contact with the oblique segment of the tab.

2. The device of claim 1 wherein the tab is made of a latex rubber.

3. A method for increasing distance traversed by a projectile, comprising:

providing a main body with an annular section that encloses an orifice and a collar section positionable about the orifice, the collar section also include an orifice for receipt of a screw, and a tab made of a deformable material having an oblique segment attached adjacent the orifice defined by the tubular section;

turning the screw until the oblique section of the tab is contacted by the screw and is moved downwardly;

attaching the main body to a barrel of a gun;

adding a projectile to the gun; and activating the gun so that the projectile contacts the tab which imparts a backspin to the projectile and increases the distance traversed by the projectile.

4. The method of claim 3 wherein the projectile is a paint ball.

5. The method of claim 3 wherein the projectile is activated by compressed air.

6. The projectile of claim 3 wherein the projectile is activated by solidified carbon dioxide.

7. A paint ball gun comprising:

a barrel that defines an orifice;

a trigger positioned within the orifice and adjacent to the barrel;

a collar component positionable on the barrel adjacent the trigger, the collar component enclosing a second orifice for receipt of a screw;

a tab positioned adjacent to the orifice defined by the barrel, within the barrel, the tab comprising an oblique segment made of a deformable material;

and a single screw positionable in the collar component, extending through the orifice defined by the barrel wherein the screw and wherein the screw is in moveable contact with the oblique segment of the tab and wherein radial movement of the screw changes orientation of the oblique segment within the barrel.

8. The device of claim 7 wherein second annular component is attached to the barrel substantially perpendicular to the barrel for receipt of paint balls.

* * * * *